US009314894B2

(12) United States Patent
Andersen et al.

(10) Patent No.: US 9,314,894 B2
(45) Date of Patent: Apr. 19, 2016

(54) DEVICE FOR CLEANING A SAFETY RAZOR BLADE

(76) Inventors: Morten Kjeldsen Andersen, Odder (DK); Bo Lander Rasmussen, Risskov (DK)

( * ) Notice: Subject to any disclaimer, the term of this patent is extended or adjusted under 35 U.S.C. 154(b) by 975 days.

(21) Appl. No.: 12/087,755

(22) PCT Filed: Jan. 12, 2007

(86) PCT No.: PCT/DK2007/000019

§ 371 (c)(1), (2), (4) Date: Aug. 25, 2008

(87) PCT Pub. No.: WO2007/079756

PCT Pub. Date: Jul. 19, 2007

(65) Prior Publication Data

US 2009/0000426 A1 Jan. 1, 2009

Related U.S. Application Data

(60) Provisional application No. 60/758,610, filed on Jan. 13, 2006.

(51) Int. Cl.

| | |
|---|---|
| ***B24B 3/48*** | (2006.01) |
| ***B24B 3/50*** | (2006.01) |
| ***B24D 15/10*** | (2006.01) |

(52) U.S. Cl.

CPC ... *B24B 3/48* (2013.01); *B24B 3/50* (2013.01); *B24D 15/10* (2013.01)

(58) Field of Classification Search

USPC ..... 451/349, 523, 539; 76/81.3

See application file for complete search history.

(56) References Cited

U.S. PATENT DOCUMENTS

| | | | | | |
|---|---|---|---|---|---|
| 1,723,124 | A | * | 8/1929 | Bencze | 76/81 |
| 1,885,659 | A | * | 11/1932 | Watson | 451/316 |
| 1,934,139 | A | * | 11/1933 | Pavitt | 76/81 |
| 2,052,021 | A | * | 8/1936 | Drachman | 15/218 |
| 2,053,219 | A | * | 9/1936 | Ganzert | 451/171 |
| 2,142,779 | A | * | 1/1939 | Faber | 451/322 |
| 2,331,370 | A | * | 10/1943 | Bowden | 132/289 |
| 2,467,650 | A | * | 4/1949 | Ashworth | 451/314 |
| 2,551,859 | A | * | 5/1951 | Thompson | 30/541 |

(Continued)

FOREIGN PATENT DOCUMENTS

| | | |
|---|---|---|
| GB | 407 904 | 3/1934 |
| GB | 932 550 | 7/1963 |
| GB | 1 391 765 | 4/1975 |

*Primary Examiner* — Monica Carter
*Assistant Examiner* — Lauren Beronja
(74) *Attorney, Agent, or Firm* — Harness, Dickey & Pierce, PLC

(57) ABSTRACT

A device for storing, sharpening, and cleaning a safety razor blade may include a polymer-based mat section, including at least one substantially plane surface, and one or more polymer-based holding elements adapted to hold a razor and the safety razor blade attached to the razor in a fixed relationship with the device. A device for sharpening and cleaning a safety razor blade may include a polymer-based mat, including at least one substantially plane surface, and a pair of guiding tracks arranged so that at least part of the polymer-based mat is arranged between the pair of guiding tracks. The pair of guiding tracks and the polymer-based mat may be arranged relative to each other in such a way that the pair of guiding tracks define a maximum allowed penetration depth of blades of the safety razor blade into the polymer-based mat.

21 Claims, 6 Drawing Sheets a)

b)

(56) References Cited

U.S. PATENT DOCUMENTS

| | | | | | |
|---|---|---|---|---|---|
| 2,809,477 | A | * | 10/1957 | Keech | 76/81 |
| 3,206,012 | A | * | 9/1965 | Braginetz | 206/228 |
| 3,367,482 | A | * | 2/1968 | Samsing | 206/228 |
| 3,735,860 | A | * | 5/1973 | Nissen et al. | 206/349 |
| 4,035,213 | A | * | 7/1977 | Thoma et al. | 156/231 |
| 5,036,731 | A | * | 8/1991 | Fletcher | 76/82 |
| 5,113,586 | A | * | 5/1992 | Lazarchik et al. | 30/541 |
| 5,114,438 | A | * | 5/1992 | Leatherman et al. | 51/296 |
| 5,139,138 | A | * | 8/1992 | Isaksen | 76/86 |
| D336,426 | S | * | 6/1993 | Fisher | D9/749 |
| 5,785,586 | A | * | 7/1998 | Delsignore | 451/556 |
| 6,062,970 | A | * | 5/2000 | Back | 451/556 |
| 6,415,517 | B1 | * | 7/2002 | Worrick, III | 30/541 |
| 6,506,106 | B2 | * | 1/2003 | Fletcher | 451/293 |
| 7,553,218 | B2 | * | 6/2009 | Morita | 451/349 |
| 2004/0040577 | A1 | * | 3/2004 | Severino | 15/218 |
| 2006/0084367 | A1 | * | 4/2006 | Spiro et al. | 451/45 |

* cited by examiner a)

b)

DEVICE FOR CLEANING A SAFETY RAZOR BLADE

CROSS-REFERENCE TO RELATED APPLICATIONS

This application is a National Phase entry of PCT Application No. PCT/DK2007/000019, filed on Jan. 12, 2007, which claims priority under 35 U.S.C. §119(e) to U.S. Provisional Application No. 60/758,610, filed on Jan. 13, 2006, in the U.S. Patent and Trademark Office.

FIELD OF THE INVENTION

The present invention relates to a razor blade sharpening and cleaning device comprising a polymer-based mat having at least one substantially plane surface, the device further comprising a pair of guiding tracks being arranged so that at least part of the polymer-based mat is arranged between said pair of guiding tracks. The guiding tracks and the polymer-based mat are arranged relative to each other in such a way that the guiding tracks define a maximum allowed penetration depth of the blades of the safety razor blade into the polymer-based mat.

BACKGROUND OF THE INVENTION

U.S. Pat. No. 5,036,731 discloses an apparatus for sharpening a razor blade. The apparatus includes a sharpening member, a housing for securing the sharpening member therein and for guiding a razor blade in back-and-forth sharpening movement within the housing. The housing has a transverse slot for inserting a head of a razor blade holder therein, and a longitudinal slot in a top plate thereof for linear movement therein of the handle which carries the blade holder. The sharpening or honing member is preferably made of a plate of glass secured to the bottom wall of the housing.

U.S. Pat. No. 6,062,970 discloses a stropping device for a blade for safety razors. The device allows an existing razor blade to be repeatedly used disclosed. The stropping device consists of a main body and an adhesive sheet attached on the back surface of the main body. A guide groove part is longitudinally formed on a front portion of the main body, while a protrusion is integrally and horizontally formed on a top portion of the main body. Also, side walls are formed at both side ends of the main body in such a manner that their outer surfaces are smoothly curved. A stropping plate member, produced from a leather material such as a natural or synthetic leather or suede, is attached on the bottom surface of the guide groove part by an adhesive means. In addition, a recess is formed on a rear portion of the protrusion in such a manner that a nail, driven in a wall in a house, is inserted into the recess.

It is a disadvantage of the sharpening device disclosed in U.S. Pat. No. 5,036,731 and U.S. Pat. No. 6,062,970 that medium upon which the razor blade is to be sharpened and is moved across do not match the hardness of the skin of the body. The mismatch implies that the blades of the razor blade are very vulnerable and are easily damaged.

It is an object of a preferred embodiment of the present invention to provide razor blade sharpener where blades of a safety razor blade are not so easily damaged.

It is a further object of a preferred embodiment of the present invention to provide razor blade sharpener where blades of a safety razor blade are sharpened against a medium having an indentation hardness similar of the indentation hardness of human skin.

SUMMARY OF THE INVENTION

The above-mentioned objects are complied with by providing, in a first aspect, a device for sharpening and cleaning a safety razor blade, the device comprising a polymer-based mat, the polymer-base mat comprising at least one substantially plane surface, and a pair of guiding tracks being arranged so that at least part of the polymer-based mat is arranged between said pair of guiding tracks wherein the guiding tracks and the polymer-based mat are arranged relative to each other in such a way that the guiding tracks define a maximum allowed penetration depth of the blades of the safety razor blade into the polymer-based mat.

The device according to the present invention may be a stand-alone device, or it may form an integral part of a toilet requisite, such as a toilet bag.

The indentation hardness of the polymer-based mat may be less than 50 measured on the Durometer Shore A scale, such as less than 40, such as less than 30, such as less than 20, such as less than 10. Thus, the polymer-based mat may have an indentation hardness similar to the hardness of the human skin. Furthermore, the material constituting the polymer-based mat may be a foodstuff-approved material. In addition, the material may be an allergic-approved material. Finally, the polymer-based mat is a very user friendly material in that cleaning after use may be done simply by using water.

The polymer-based mat may be made of an injection mouldable material, such as post cured injection mouldable silicone, which is also suitable for mass production. In addition, the polymer-based mat may comprise channels or pores adapted to accommodate an abrasive, a liquid soap or a liquid shampoo. Thus, the polymer-based mat itself may accommodate the abrasive, soap or shampoo. A sufficient amount of abrasive, soap or shampoo may be released from the polymer-based mat via the channels or pores by slightly compressing the polymer-based mat.

The polymer-based mat may have a varying indentation hardness across the at least one substantially plane surface. A varying indentation hardness may be provided in various ways, such as for example by introducing one or more recesses in a surface opposing the at least one substantially plane surface. By providing such one or more recesses the indentation hardness of the at least one substantially plane surface will be soft in an area coinciding with a recess, whereas the indentation hardness of an area not coinciding with a recess will not be softened by the recess/recesses.

The pair of guiding tracks may be arranged in a substantially parallel manner. Each of the two guiding tracks may be adapted to support and guide an end portion of the safety razor blade. In this way the pair of guiding tracks defines the in-depth movement of the safety razor blade relative to the polymer-based mat. This control of the in-depth movement of the safety razor blade relative to the polymer-based mat ensures the cutting edges of the safety razor blade are not exposed to forces that damage the fragile cutting edges.

The device according to the present invention may further comprise a substantially rigid frame structure, said frame structure being fabricated of a material suitable for injection moulding. This material may for example be a polymer, such as plastic. Preferably, the pair of guiding tracks form an integral part of the substantially rigid frame structure.

The substantially rigid frame structure may comprise an opening or an indentation adapted to at least partly housing the polymer-based mat. In a preferred embodiment the opening forms a through-going opening or through-going openings in the frame structure. By arranging the opening or openings as through-going openings the polymer-based mat may be arranged in such as manner that it forms a non-slipping surface which will allow, that the device may be positioned on a substantially plane support, such as the surface of a table, with a secure grip in that surface. Thus, opposing sides of the polymer-based mat may form 1) a substantially plane surface to be used when a safety razor blade is to sharpened and/or cleaned, and 2) an opposing surface or opposing surface part which extends all the way through the substantially rigid frame structure thereby establishing a non-slipping arrangement of the device.

In a second aspect, the present invention relates to a method for sharpening and cleaning a safety razor blade, the method comprising the steps of

- providing a polymer-based mat, the polymer-base mat comprising at least one substantially plane surface,
- providing an abrasive or a cleaning material on at least part of the substantially plane surface of the mat, and
- moving or sliding the safety razor blade across the substantially plane surface of the mat in a direction opposite the shaving direction, the safety razor blade being moved in a manner so that at least part of the abrasive is distributed over at least part of the substantially plane surface of the mat.

By moving or sliding is meant that the safety razor blade is moved across the mat, while being in contact with it, a predetermined number of times. This number of times could be between 3-5. In order not the damage the polymer-based mat direction of movement of the safety razor blade is opposite to the normal shaving direction. By cleaning material is meant a liquid soap, a liquid shampoo or the like.

The overall idea between the present invention is that the polymer-based mat should simulate the human skin. For the same reason, the indentation hardness of the polymer-based mat may be less than 50 measured on the Durometer Shore A scale, such as less than 40, such as less than 30, such as less than 20, such as around 10. Thus, the polymer-based mat may have an indentation hardness similar to the hardness of the human skin. A suitable abrasive may be an abrasive similar to abrasives/cleaners used for cleaning glass/ceramic cooktops. However, other abrasives containing aluminium oxide may also be applicable. The providing of the abrasive or the cleaning material may be performed via channels or pores formed in the polymer-based mat itself.

By applying the method according to the present invention the lifetime of safety razor blades may be increased by a factor of up to five.

In a third aspect, the present invention relates to the use of a polymer-based mat in combination with an aluminium oxide containing abrasive for sharpening and cleaning a safety razor blade. The use may comprise the steps of providing the abrasive on at least a part of the mat, such as on at least part of a substantially plane surface, and sliding the safety razor blade across the substantially plane surface of the mat in a manner so that at least part of the abrasive is distributed over at least part of the substantially plane surface of the mat.

In a fourth aspect, the present invention relates to the use of a polymer-based mat in combination with a cleaning material for sharpening and cleaning a safety razor blade. The use may comprise the steps of providing the cleaning material on at least a part of the mat, such as on at least part of a substantially plane surface, and sliding the safety razor blade across the substantially plane surface of the mat in a manner so that at least part of the cleaning material is distributed over at least part of the substantially plane surface of the mat. As mentioned above the term cleaning material is meant to comprise liquid soap, liquid shampoo or the like.

In a fifth aspect, the present invention relates to a device for storing, sharpening and cleaning a safety razor blade, the device comprising a polymer-based mat section comprising at least one substantially plane surface, and one or more polymer-based holding elements for holding the safety razor blade in a fixed relationship with the device.

The polymer-based mat section may comprise a mat with properties similar to the mat according to the first aspect of the present invention. Thus, the indentation hardness of the polymer-based mat section may be less than 50 measured on the Durometer Shore A scale, such as less than 40, such as less than 30, such as less than 20, such as less than around 10. Similarly, the polymer-based mat section may comprise channels or pores adapted to accommodate an abrasive or a cleaning material, such as liquid soap or liquid shampoo.

The device according to the fifth aspect may form a one-piece component comprising one polymer-based material, such as silicone. The device may be fabricated using an injection moulding process.

The polymer-based mat region may have a varying indentation hardness across the at least one substantially plane surface. A varying indentation hardness may be provided in various ways, such as for example by introducing one or more recesses in a surface opposing the at least one substantially plane surface. By providing such one or more recesses the indentation hardness of the at least one substantially plane surface will be soft in an area coinciding with a recess, whereas the indentation hardness of an area not coinciding with a recess will not be softened by the recess/recesses.

The polymer-based mat section may be arranged between a first and a second polymer-based holding element, wherein the first polymer-based holding element may comprise a first receiving member adapted to receive and hold a handle of the safety razor blade. The second polymer-based holding element may comprise a second receiving member adapted to receive and hold a front portion of the safety razor blade. Each of the first and second receiving members may comprise one or more retaining elements for retaining respective portions of the safety razor blade in the first and second receiving elements. These one or more retaining members may form an integral part of the device in that the one or more retaining members may be formed as protrusions arranged at an entry to each of the first and second receiving members. According to one embodiment each receiving member comprises two retaining members.

The second polymer-based holding element may further comprise a recess adapted to accommodate a razor head of the safety razor blade when such safety razor blade is positioned in the device.

BRIEF DESCRIPTION OF THE DRAWINGS

The invention will now be explained in further details with reference to the accompanying figures, wherein.

Figure 1:
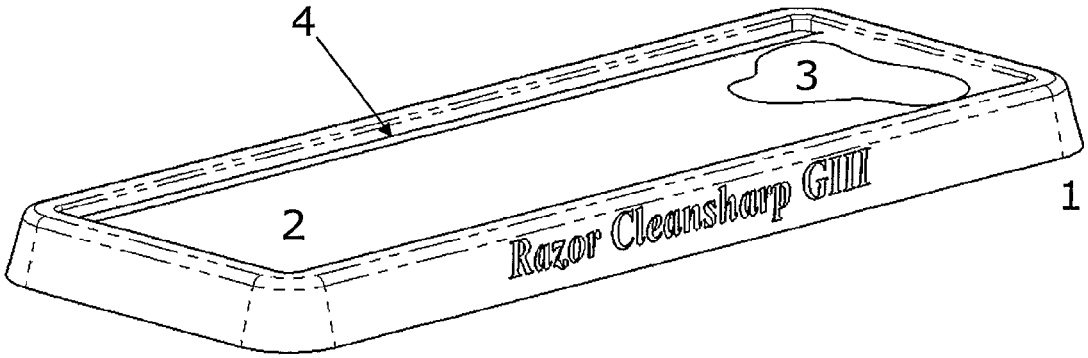
FIG. 1 shows the principle behind the present invention.
Figure 1:
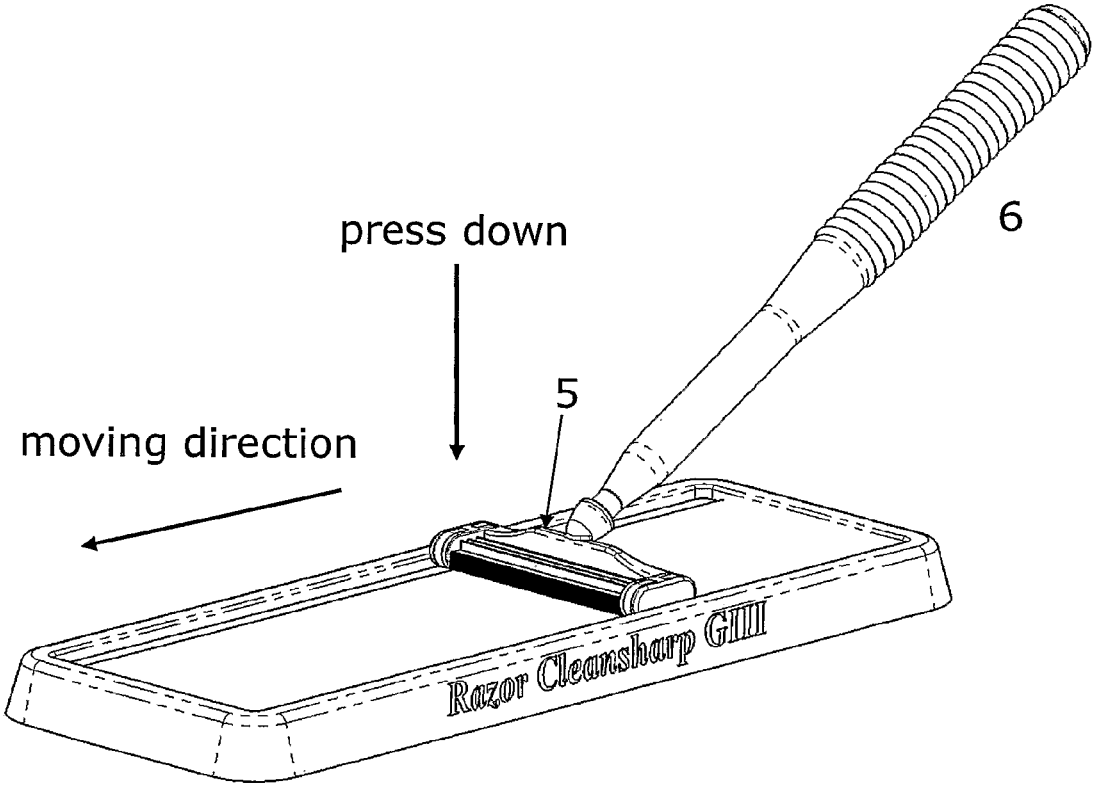

While the invention is susceptible to various modifications and alternative forms, specific embodiments have been shown by way of example in the drawings and will be described in details herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its most general aspect the present invention relates to a device for sharpening and cleaning safety razor blades. The invention comprises a polymer-based mat having an indentation hardness of around 10 on the Durometer Shore A scale. A safety razor blade is sharpened and cleaned by moving the safety razor blade across the polymer-based under the influence of an added abrasive or an added cleaning material. The direction of movement of the safety razor blade relative to the polymer-based mat is opposite the normal shaving direction. By moving the safety razor blade over the polymer-based mat under the influence of the added abrasive or the added cleaning material the cutting edges of the blades are refreshed in that deposits on the cutting edges are effectively removed. Cleaning of the device is easily performed by using water.

In one embodiment of the present invention the polymer-based mat comprises channels or pores adapted to accommodate or house the abrasive or cleaning material. Thus, the polymer-based mat itself may be capable of accommodating an amount of abrasive or cleaning material sufficient for sharpening and cleaning the razor blade. The required abrasive or cleaning is released from the polymer-based mat via the channels or pores by slightly compressing the polymer-based mat with the razor blade.

Referring now to FIG. 1*a* a device according to the present invention is depicted. FIG. 1 shows a frame structure 1 having a polymer-based mat 2 arranged therein. Along the long sidewall portions of the frame structure a pair of guiding tracks 4 (only one track is visible in FIG. 1) are arranged. The height of the frame structure 1 exceeds the height of the polymer-based mat which helps preventing that an added abrasive or an added cleaning material 3 leaves the polymer-based mat. Preferably, the frame structure 1 is fabricated in a material suitable for injection moulding, such as for example plastic. In FIG. 1*b* a safety razor blade 5 including a handle 6 has been positioned in the device. As depicted in FIG. 1*b* the safety razor blade is pressed towards the polymer-based mat by use of the handle 6 and moved across the polymer-based mat as indicated by the arrow. During this movement of the safety razor blade, at least part of the added abrasive or the added cleaning material 3 is distributed over the polymer-based mat 2.

Figure 2:
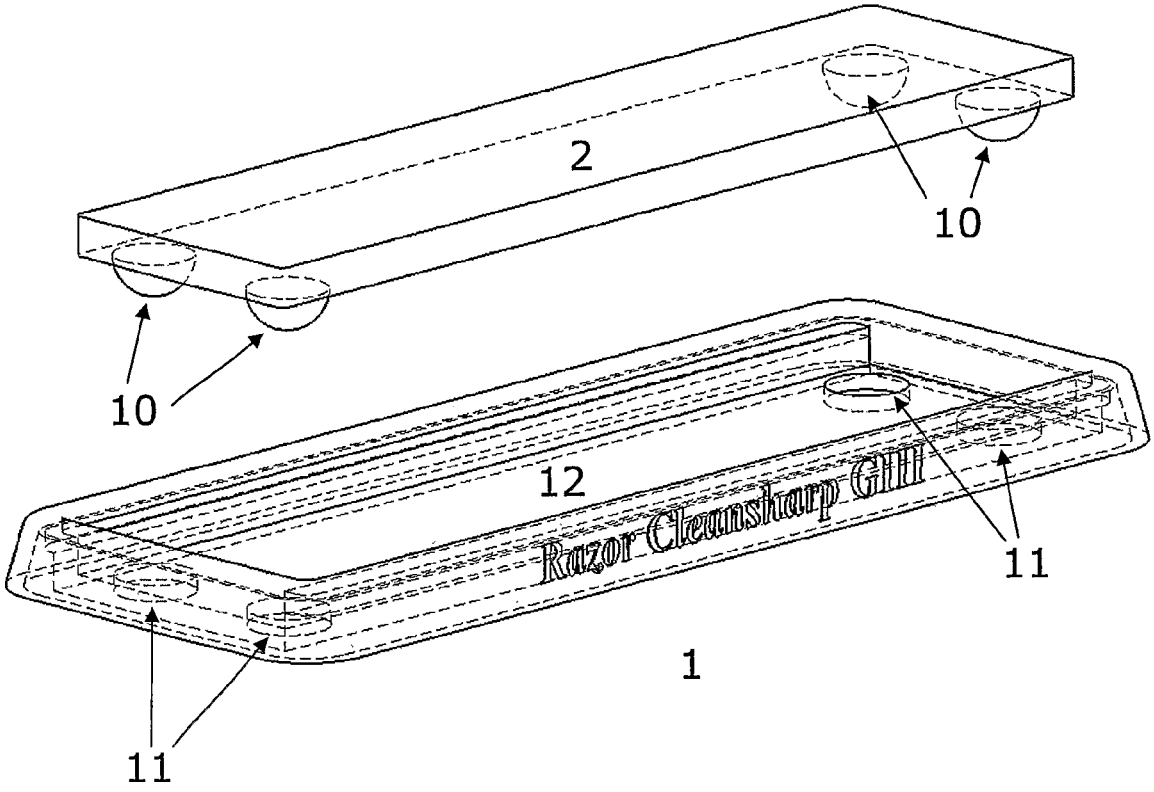
FIG. 2 shows an exploded view of the device according to the present invention.

FIG. 2 shows an exploded view of the device according to the present invention. As seen the frame structure 1 comprises a substantially rectangular sidewall portion with an indentation 12 arranged therein. In the bottom surface of this indentation 12 four through-going openings 11 are arranged. The number of through-going holes 11 may obviously be different from four and they may be arranged in a different manner. The indentation 12 is adapted to receive and hold the polymer-based mat 2 which will be kept in position by the rectangular-shaped sidewall portion. Obviously, the form of the sidewall portion may be different from rectangular and may thus be elliptical, quadratic or the like. The form of the polymer-based mat 2 may obviously also be different from rectangular as long as it fits into the indentation formed in the frame structure 1. As depicted in FIG. 2 the polymer-based mat 2 comprises four protrusions 10 which fit into the through-going openings 11. The number four is just exemplary, thus, the number of protrusions may be different from four, and the protrusions may be arranged differently. These four protrusions 10 form a non-slipping fixture to an underlying surface, such as the surface of a bathroom table.

Figure 3:
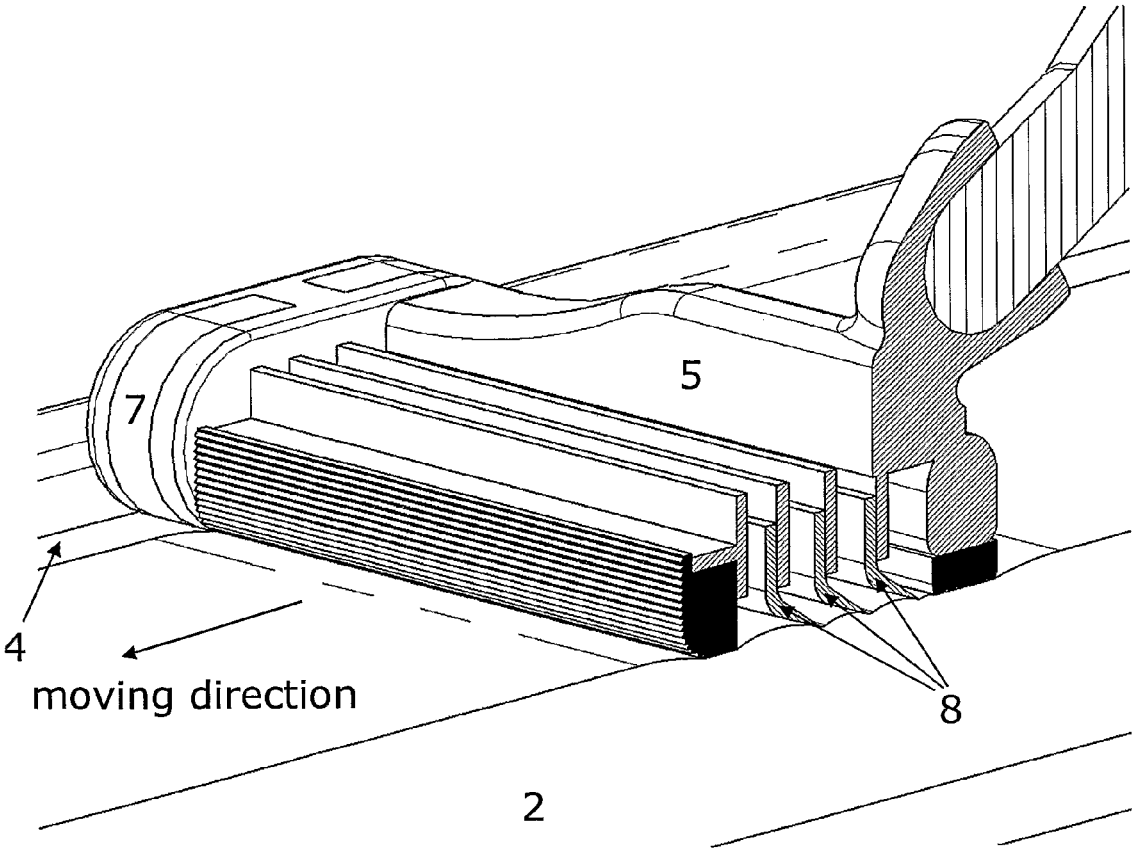
FIG. 3 shows a cross-sectional view of a safety razor blade positioned on a polymer-based mat.

An enlarge depiction showing a safety razor blade 5 having three blades positioned on the polymer-based mat 2 is shown in FIG. 3. As seen the end portion 7 of the safety razor blade 5 abuts the guiding track 4. Thus, the guiding track 4 defines the maximum indentation depth of the blades 8 into the polymer-based mat 2.

Figure 4:
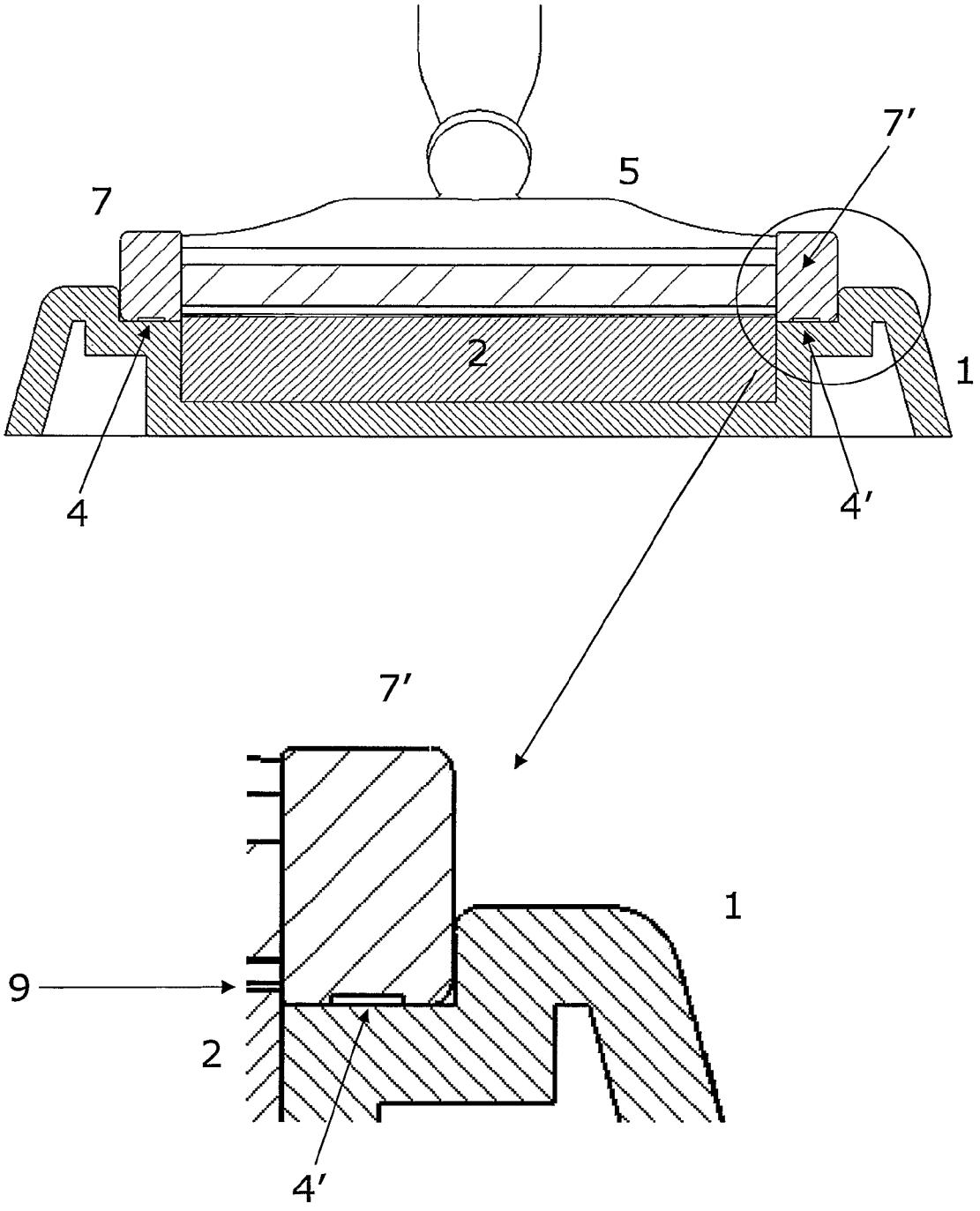
FIG. 4 shows a cross-sectional front view of a safety razor blade positioned on a polymer-based mat.

A cross-sectional front view is shown in FIG. 4. In addition, an enlarged portion of the right hand side of the upper figure is shown. FIG. 4 shows a safety razor blade 5 positioned in the frame structure 1 so that the end portions 7, 7' abut guiding tracks 4, 4'. The polymer-based mat 2 is positioned in the opening/indentation of the frame structure 1. When the safety razor blade 5 is to be sharpened or cleaned it is moved in the direction out of the paper. The enlarged figure shown in the bottom of FIG. 4 shows that the upper surface 9 of the polymer-based mat 2 is slightly elevated, about 1 mm, relative to the guiding track 4'.

Figure 5:
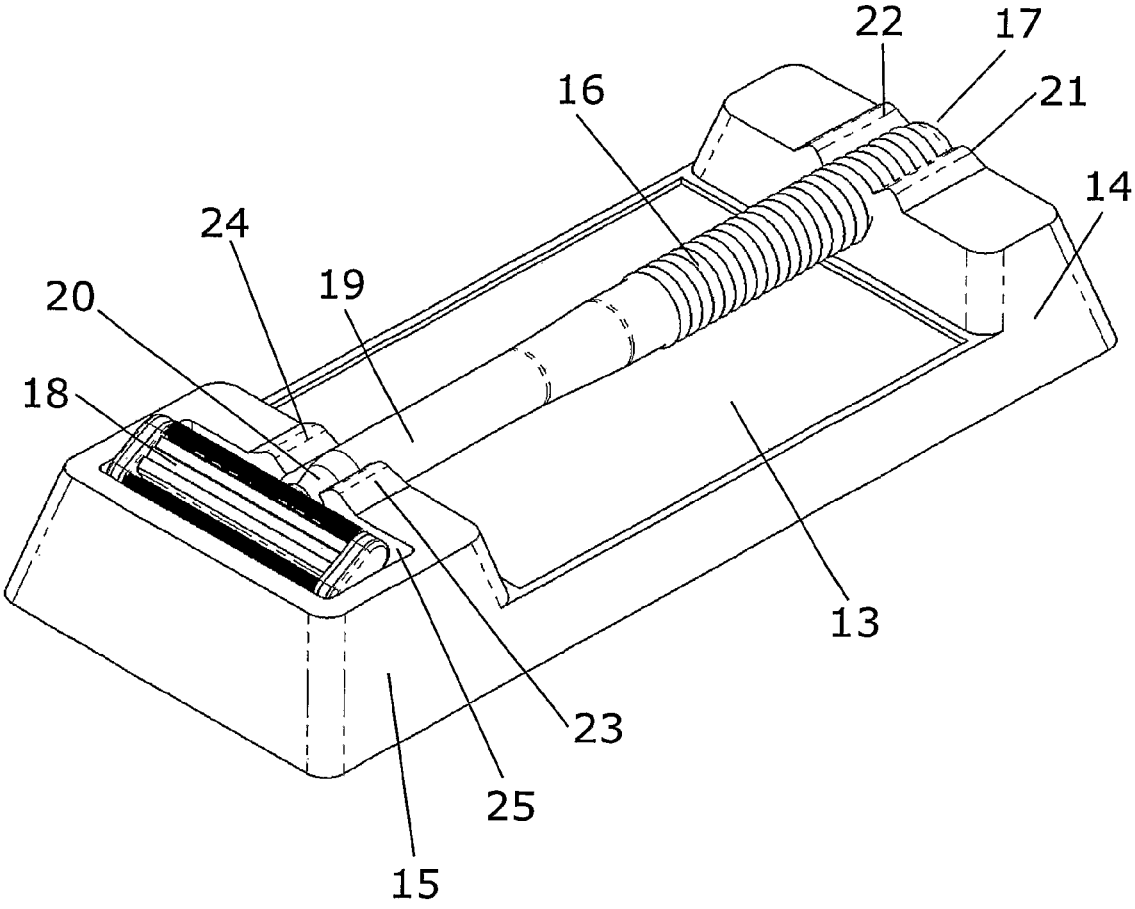
FIG. 5 shows a safety razor blade positioned on a polymer-based holder with the razor blades arranged upwards to secure effective drying of the razor blades.

FIG. 5 shows a polymer-based safety razor blade holder. The safety razor blade holder according to FIG. 5 is fabricated by a polymer material, such as silicone, only. Preferably, the safety razor blade holder of FIG. 5 is fabricated as a one-piece component using for example an injection moulding fabrication process. As depicted in FIG. 5 the holder comprises a middle portion 13 and two end portions 14, 15. The middle portion 13 comprises a substantially planar surface across which the razor blades 18 are adapted to be moved during sharpening/cleaning. End portion 14 comprises a flexible receiving arrangement 17 adapted to receive and hold a handle 16 of the razor. Since the end portion 14 is made of a polymer material the receiving arrangement 17 is capable of receiving and holding razor handles with varying dimensions. In order to retain the handle 16 in the receiving arrangement 17 two retaining members 21, 22 are provided. As depicted in FIG. 5 the safety razor blade holder is capable of holding the razor in a position where the razor blades 18 are pointing upwards, i.e. away from the razor blade holder. By positioning the razor blades 18 in this manner the razor blades 18 are allowed to dry in an effective manner without oxidation of the razor blades 18. Such oxidation of the razor blades 18 may easily damage the razor blades 18. Thus, by positioning the razor blade as depicted in FIG. 5 corrosion and thereby related damage of the razor blades 18 is minimized. The front portion 19 of the razor is received and held by a flexible receiving arrangement 20 which is capable of receiving and holding front ends of razors with varying dimensions. In order to retain the front portion 19 in the receiving arrangement 20 two retaining members 23, 24 are provided. In addition, a recess 25 is provided in end portion 15 for accommodating the head of the razor blade.

Figure 6:
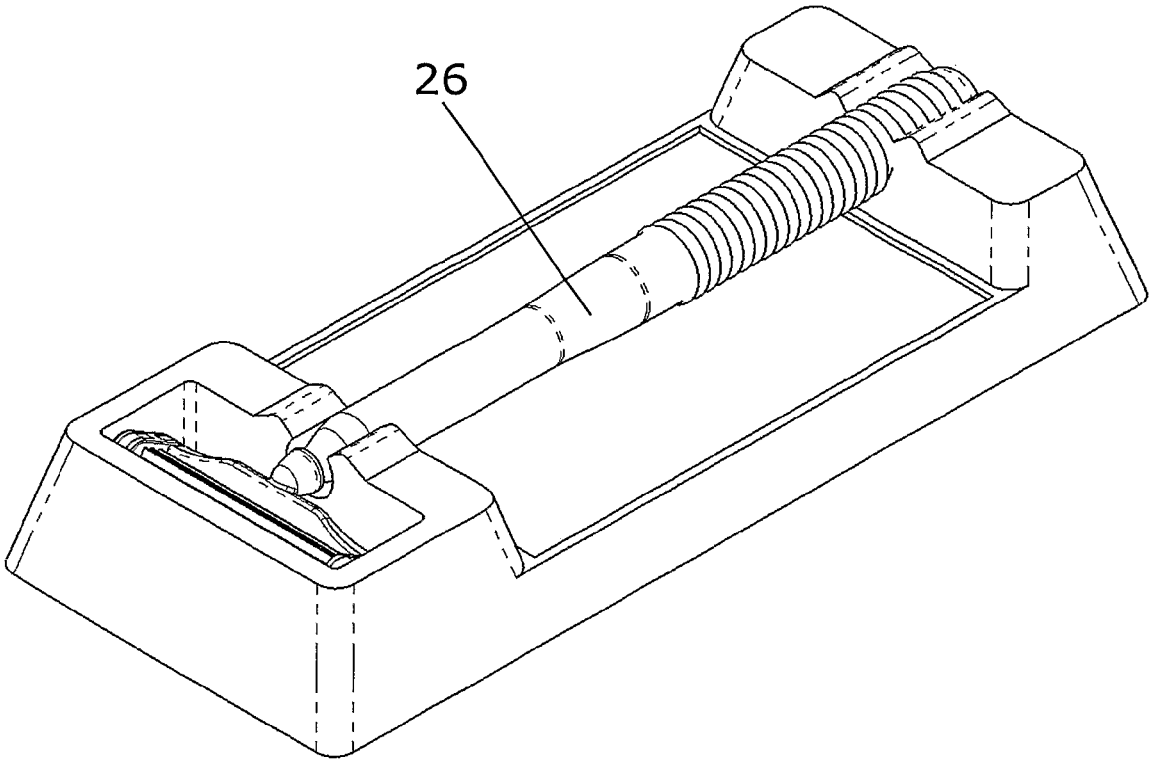
FIG. 6 shows a safety razor blade positioned on a polymer-based holder with the razor blades arranged downwards to secure effective protection of the razor blades.

FIG. 6 shows the polymer-based safety razor blade holder also depicted in FIG. 5. However, in FIG. 6 the razor 26 is positioned with razor blades pointing downwards, i.e. towards the razor blade holder. By positioning the razor blades in this manner the razor blades are effectively protected during transport. Particularly, the razor blade is protected against mechanical shocks—for example if the razor blade holder is accidentally dropped.

The invention claimed is:

1. A device for cleaning a safety razor blade, the device comprising:

a polymer-based mat section comprising at least one substantially plane surface having an indentation hardness being less than 50 measured on the Durometer Shore A scale, said polymer-based mat section being arranged between a first polymer-based holding element and a second polymer-based holding element;

wherein the first polymer-based holding element comprises a flexible first receiving member configured to receive and hold razor handles with varying dimensions, and wherein the second polymer-based holding element comprises a flexible second receiving member configured to receive and hold front portions of razors with varying dimensions so as to hold a razor and the safety razor blade attached thereto in a fixed relationship with the device.

2. The device of claim 1, wherein the indentation hardness of the polymer-based mat section varies across the at least one substantially plane surface.

3. The device of claim 1, wherein the flexible first receiving member comprises one or more retaining elements configured to retain the razor handles in the one or more retaining elements.

4. The device of claim 1, wherein the flexible second receiving member comprises a recess configured to accommodate a razor head of the razor.

5. A device for cleaning a safety razor blade that comprises blades fixed between first and second end portions of the safety razor blade, the device comprising:

a polymer-based mat, the polymer-based mat comprising at least one substantially plane surface having an indentation hardness being less than 50 measured on the Durometer Shore A scale; and first and second guiding tracks arranged so that at least part of the polymer-based mat is also arranged between the first and second guiding tracks;

wherein the first and second guiding tracks and the polymer-based mat are arranged relative to each other in such a way that the substantially plane surface of the polymer-based mat is elevated relative to the first and second guiding tracks, and wherein contact between the first end portion and the first guiding track and between the second end portion and the second guiding track defines a maximum allowed penetration depth of the blades of the safety razor blade into the substantially plane surface of the polymer-based mat.

6. The device of claim 5, wherein the indentation hardness of the polymer-based mat varies across the at least one substantially plane surface.

7. The device of claim 5, wherein the first and second guiding tracks are arranged in a substantially parallel manner, wherein the first guiding track is configured to support and guide the first end portion of the safety razor blade, and wherein the second guiding track is configured to support and guide the second end portion of the safety razor blade.

8. The device of claim 5, further comprising:

a substantially rigid frame structure;

wherein the substantially rigid frame structure is fabricated of a material suitable for injection moulding.

9. The device of claim 8, wherein the first and second guiding tracks form an integral part of the substantially rigid frame structure.

10. The device of claim 8, wherein the substantially rigid frame structure comprises an opening or an indentation configured to at least partly house the polymer-based mat.

11. The device of claim 10, wherein the opening forms a through-going opening in the substantially rigid frame structure.

12. The device of claim 11, wherein the polymer-based mat is arranged in the opening so that the polymer-based mat forms a non-slipping arrangement when the device is positioned on a substantially plane support.

13. The device of claim 1, wherein the indentation hardness of the polymer-based mat section is less than 40 measured on the Durometer Shore A scale.

14. The device of claim 1, wherein the indentation hardness of the polymer-based mat section is less than 30 measured on the Durometer Shore A scale.

15. The device of claim 1, wherein the indentation hardness of the polymer-based mat section is less than 20 measured on the Durometer Shore A scale.

16. The device of claim 5, wherein the indentation hardness of the polymer-based mat section is less than 40 measured on the Durometer Shore A scale.

17. The device of claim 5, wherein the indentation hardness of the polymer-based mat is less than 30 measured on the Durometer Shore A scale.

18. The device of claim 1, wherein the polymer-based mat section comprises channels or pores configured to accommodate an abrasive or cleaning material.

19. The device of claim 5, wherein the polymer-based mat comprises channels or pores configured to accommodate an abrasive or cleaning material.

20. The device of claim 1, wherein the device forms a one-piece component comprising one polymer-based material.

21. The device of claim 20, wherein the polymer-based material is silicone.

* * * * *